US009903200B2

(12) United States Patent
Sroka et al.

(10) Patent No.: US 9,903,200 B2
(45) Date of Patent: Feb. 27, 2018

(54) VISCOSITY MEASUREMENT IN A FLUID ANALYZER SAMPLING TOOL

(75) Inventors: Stefan Sroka, Adelheidsdorf Niedersachsen (DE); Thomas Kruspe, Niedersachsen (DE); Peter Schaefer, Grob Kreutz (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1255 days.

(21) Appl. No.: 13/550,661

(22) Filed: Jul. 17, 2012

(65) Prior Publication Data

US 2013/0019673 A1 Jan. 24, 2013

Related U.S. Application Data

(60) Provisional application No. 61/509,318, filed on Jul. 19, 2011.

(51) Int. Cl.
*E21B 47/08* (2012.01)
*E21B 49/08* (2006.01)

(52) U.S. Cl.
CPC ..... *E21B 49/08* (2013.01)

(58) Field of Classification Search
CPC ..... E21B 49/10; E21B 49/08; E21B 47/10; G01N 33/2823
USPC ..... 73/152.55
See application file for complete search history.

(56) References Cited

U.S. PATENT DOCUMENTS 2,782,629 A 2/1957 Norcross
4,447,224 A * 5/1984 DeCant, Jr. ..... A61M 5/14276 128/DIG. 12
4,715,022 A * 12/1987 Yeo ..... E21B 47/18 175/40
5,161,959 A 11/1992 Gettel
5,213,477 A * 5/1993 Watanabe ..... F04B 49/065 417/20
5,741,977 A 4/1998 Agar et al.
7,082,843 B2 * 8/2006 Clark ..... A61M 5/16813 73/861.53
7,673,507 B2 3/2010 Walters et al.
(Continued)

FOREIGN PATENT DOCUMENTS

EP 2072971 A1 6/2009

OTHER PUBLICATIONS

Notification of Transmittal of the International Search Report and the Written Opinion of the International Searching Authority, or the Declaration; PCT/US2012/047162; dated Jan. 23, 2013.
(Continued)

*Primary Examiner* — Hezron E Williams
*Assistant Examiner* — Rodney T Frank
(74) *Attorney, Agent, or Firm* — Cantor Colburn LLP

(57) ABSTRACT

An apparatus for estimating a viscosity or density of a fluid downhole includes a carrier configured to be conveyed through a borehole penetrating the earth. A pump is disposed at the carrier and configured to pump the fluid. A flow restriction element is configured to receive a flow of the fluid pumped by the pump and to reduce pressure of the fluid flowing through the flow restriction element. A sensor is configured to measure a differential pressure across the flow restriction element and to provide an output that is used to estimate the viscosity or density.

13 Claims, 6 Drawing Sheets

(56) References Cited

U.S. PATENT DOCUMENTS

| | | | | |
|---|---|---|---|---|
| 7,784,330 | B2 | 8/2010 | Angelescu et al. | |
| 2004/0187598 | A1* | 9/2004 | Shiba | G01F 1/46 73/861.52 |
| 2009/0189617 | A1* | 7/2009 | Burns | E21B 43/24 324/649 |
| 2009/0260823 | A1* | 10/2009 | Prince-Wright | C10G 21/22 166/302 |
| 2009/0308603 | A1* | 12/2009 | Borgstadt | B25J 9/1664 166/250.15 |
| 2009/0321072 | A1 | 12/2009 | Kanayama et al. | |
| 2011/0040485 | A1* | 2/2011 | Ong | E21B 47/10 702/12 |
| 2011/0192592 | A1* | 8/2011 | Roddy | E21B 47/01 166/250.01 |
| 2011/0192594 | A1* | 8/2011 | Roddy | E21B 33/13 166/250.01 |
| 2011/0192597 | A1* | 8/2011 | Roddy | E21B 33/13 166/253.1 |
| 2011/0192598 | A1* | 8/2011 | Roddy | E21B 33/13 166/253.1 |
| 2011/0199228 | A1* | 8/2011 | Roddy | E21B 33/13 340/856.4 |
| 2012/0260641 | A1* | 10/2012 | Opdenbosch | E02F 9/2217 60/327 |
| 2013/0319132 | A1* | 12/2013 | Lupeau | G01F 1/36 73/861.04 |
| 2014/0013857 | A1* | 1/2014 | Lupeau | G01F 1/44 73/861.04 |

OTHER PUBLICATIONS

Agoston, et al. "Viscosity sensors for engine oil condition monitoring—Application and interpretation of results". Science Direct, Sensors and Actuators A 121 (2005) 327-332.

* cited by examiner

VISCOSITY MEASUREMENT IN A FLUID ANALYZER SAMPLING TOOL

CROSS REFERENCE TO RELATED APPLICATIONS

This application claims the benefit of an earlier filing date from U.S. Provisional Application Ser. No. 61/509,318 filed Jul. 19, 2011, the entire disclosure of which is incorporated herein by reference.

BACKGROUND

It is important to know the viscosity of fluids in geologic formations for various geophysical reasons such as hydrocarbon exploration and production, carbon sequestration and geothermal production. In addition to knowing the viscosity, it is also important to know the viscosity of formation fluids at ambient conditions. For example, the potential for commercial success of a hydrocarbon well can be estimated by knowing the viscosity of the reservoir fluid at the pressure and temperature of the reservoir.

Boreholes are drilled deep into the earth to gain access to the formation and formation fluids. Once the fluids are accessed, tests on the fluids can be performed downhole. Typically, very high pressures and temperatures are encountered by test tools and instruments when they are disposed deep into the boreholes. Accurate measurements require these tools and instruments to function properly in the extreme downhole environment. Additionally, the tools and instruments must be compact in order to fit within the boreholes. Hence, it would be well received in the geophysical drilling industry if compact tools and instruments could be developed for measuring the viscosity of downhole fluids at downhole ambient conditions.

BRIEF SUMMARY

Disclosed is an apparatus for estimating a viscosity or density of a fluid downhole. The apparatus includes a carrier configured to be conveyed through a borehole penetrating the earth. A pump is disposed at the carrier and configured to pump the fluid. A flow restriction element is configured to receive a flow of the fluid pumped by the pump and to reduce pressure of the fluid flowing through the flow restriction element. A sensor is configured to measure a differential pressure across the flow restriction element and to provide an output that is used to estimate the viscosity or density.

Also disclosed is a method for estimating a viscosity or density of a fluid downhole. The method includes: conveying a carrier through a borehole penetrating the earth; pumping the fluid with a pump disposed at the carrier; flowing the pumped fluid through a flow restriction element; sensing a differential pressure across the flow restriction element; and using the differential pressure to estimate the viscosity or density.

Further disclosed is an apparatus for estimating a viscosity or density of a fluid downhole. The apparatus includes a carrier configured to be conveyed through a borehole penetrating the earth. A pump is disposed at the carrier and configured to pump the fluid. A flow restriction element is configured to receive a flow of the fluid pumped by the pump and to reduce pressure of the fluid flowing through the flow restriction element. A pressure switch is configured to indicate a differential pressure across the flow restriction element. A cross-sectional flow area of the flow restriction element when a selected differential pressure is measured by the pressure switch is used to estimate the viscosity or density.

Further disclosed is a method for estimating a viscosity or density of a fluid downhole. The method includes: conveying a carrier through a borehole penetrating the earth; pumping the fluid with a pump disposed at the carrier; flowing the pumped fluid through a flow restriction element; sensing a differential pressure across the flow restriction element; measuring a size of a flow restriction in the flow restriction element at a selected differential pressure; and using the size of the flow restriction to estimate the viscosity or density.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the Figures.

Figure 1:
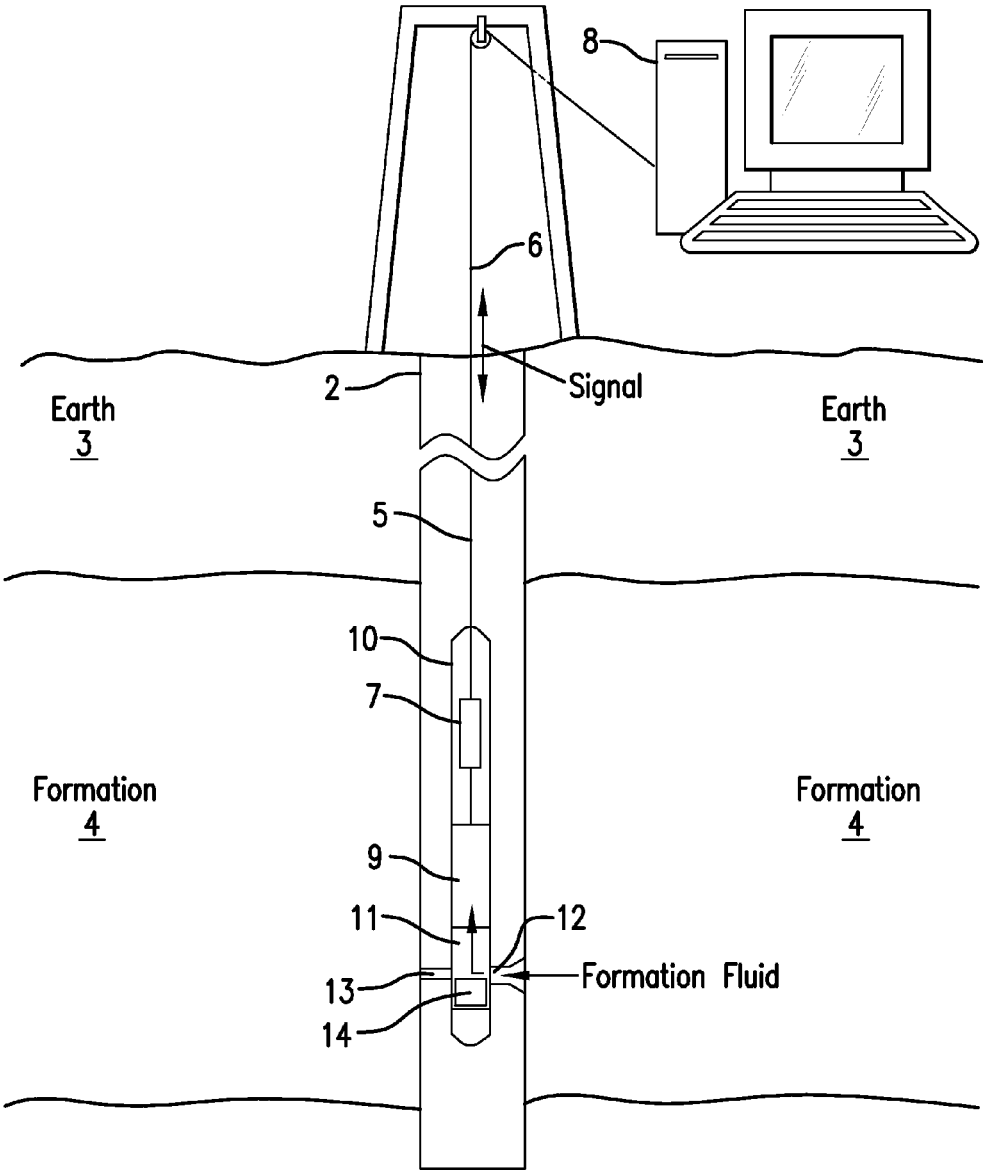
FIG. 1 illustrates an exemplary embodiment of a downhole tool disposed in a borehole penetrating the earth.

FIG. 1 illustrates an exemplary embodiment of a logging tool 10 disposed in a borehole 2 penetrating the Earth 3 having a geologic formation 4. As used herein, the term "formation" includes any subsurface materials/fluids of interest that may be analyzed to estimate a property thereof. The logging tool 10 is supported and conveyed through the borehole 2 by a carrier 5. In an operation referred to as wireline logging, the carrier 5 is an armored wireline 6. In addition to supporting the logging tool 10, the wireline 6 can be used to communicate information, such as data and commands, between the logging tool 10 and a computer processing system 8 at the surface of the Earth 3. Downhole electronics 7 disposed at the tool 10 are configured to operate the tool 10 and/or provide a communications interface with the computer processing system 8.

In another operation referred to as logging-while-drilling (LWD) or measurement-while-drilling (MWD), the logging tool 10 is disposed at a drilling tubular such as a drill string or coiled tubing and is conveyed through the borehole 2 while the borehole 2 is being drilled. In LWD/MWD, the logging tool 10 performs a measurement of a property of a subsurface material/fluid generally during a temporary halt in drilling.

Still referring to FIG. 1, the downhole tool 10 includes a formation fluid tester 11 configured to perform one or more measurements on fluid extracted from the formation 4. The formation fluid tester includes a probe 12 configured to extend from the downhole tool 10 and seal with a wall of the borehole 2. An optional extendable brace 13 is configured to brace the tool 10 against the borehole wall to allow the probe 12 to seal to the wall. A pump 14 coupled to the probe 12 is configured to lower the pressure internal to the probe 12 in order to draw a sample of formation fluid from the formation 4. A viscosity sensor 9, also referred to as the viscosimeter 9, is disposed at the tool 10 and configured to measure the viscosity of the extracted fluid. The viscosimeter 9 can be disposed in a fluid conduit carrying the extracted fluid or it can be integrated into the pump 14.

The viscosimeter 9 can determine the viscosity of a fluid of interest by flowing the fluid through a flow restriction element thereby causing a differential pressure about or across the flow restriction element. By knowing or measuring the differential pressure, the size of the flow restriction in the flow restriction element, and the flow rate through the flow restriction element, the viscosity of the fluid can be determined. In one or more embodiments, various fluids that may be expected downhole (i.e., disposed in the borehole 2) are tested in a laboratory to determine their viscosity using the viscosimeter 9 or similar apparatus. In general, the tested fluids have different viscosities. The data collected from the testing process is then used as reference data to produce characteristic curves for the various fluids. Data obtained with the viscosimeter 9 is then compared to the reference data or characteristic curves to determine the viscosity of the fluid being tested downhole. If the measured data of the fluid of interest does not exactly correspond to the reference data or characteristic curves, then that data can be interpolated against the reference data or curves.

Figure 2:
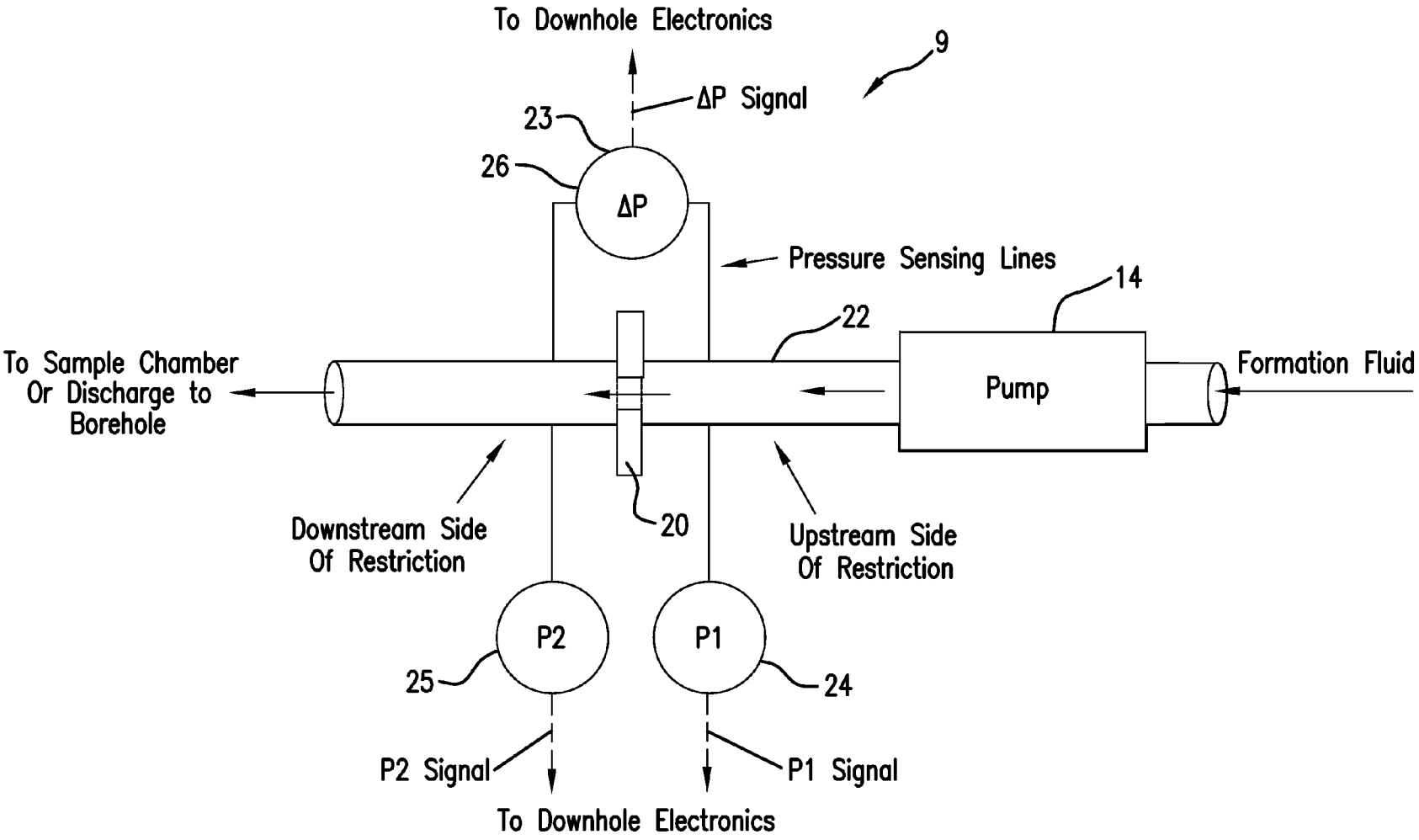
FIG. 2 depicts aspects of a viscosimeter for measuring a viscosity of a fluid downhole.

Reference may now be had to FIG. 2, which depicts aspects of the viscosimeter 9. The viscosimeter 9 includes a flow restriction element 20, which in one example is a metering orifice. The fluid of interest is pumped through the flow restriction element 20 by the pump 14. In one or more embodiments, the pump 14 is a positive displacement pump having a known volumetric pump rate, which can be fixed or variable. The pump 14 can be electrically or hydraulically driven. The pumped fluid of interest is carried by a fluid conduit 22 to the flow restriction element 20. From the flow restriction element 20, the fluid of interest can be directed to a sample chamber (not shown) for further testing or it can be discharged into the borehole 2. From Bernoulli's principle, the pressure on the upstream side of the flow restriction element 20 is greater than the pressure on the downstream side of the flow restriction element 20 causing a differential pressure ($\Delta P$) across the flow restriction element 20. In one or more embodiments, the differential pressure is sensed by a differential pressure sensor 23. In one or more embodiments, a first pressure sensor 24 senses pressure (P1) on the upstream side of the flow restriction element 20 and a second pressure sensor 25 senses pressure (P2) on the downstream side of the element 20. A difference between the readings of the two sensors 24 and 25 is calculated (P1−P2) to determine the differential pressure ($\Delta P$). In another embodiment, a differential pressure switch 26 gives a digital output as soon as a certain differential pressure is reached.

Figure 3:
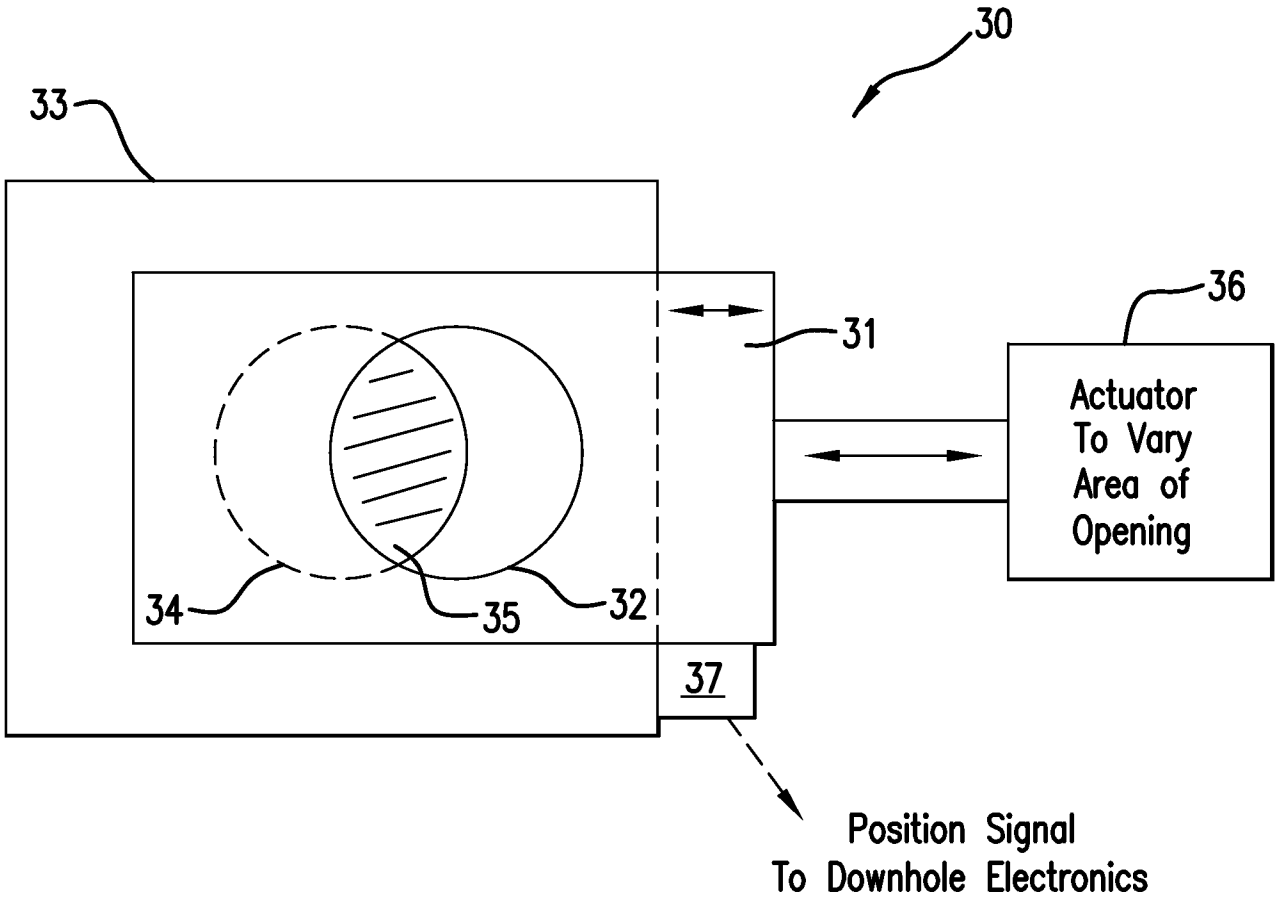
FIG. 3 depicts aspects of a flow restriction element having a variable cross-sectional flow area.

Reference may now be had to FIG. 3, which depicts aspects of the flow restriction element 20 having a variable flow restriction. This type of flow restriction element is referred to as a variable flow restriction element 30. The variable flow restriction element 30 includes a first plate 31 defining a first opening 32 and a second plate 33 defining a second opening 34. The plates 31 and 33 are configured to slide over each other in order to vary a cross-sectional flow area 35 defined by the intersection of the openings 32 and 34. Hence, the restriction caused by the cross-sectional flow area 35 can be varied by sliding one plate with respect to the other plate. An actuator 36 is coupled to the first plate 31 and/or the second plate 33 and configured to move one plate with respect to the other plate to vary the size of the cross-sectional flow area 35. The plates 31 and 33 can be flat as shown in FIG. 3 or they can be curved. When the plates 31 and 33 are curved, the plates can be rotated with respect to each other in order to vary the cross-sectional flow area 35. A position sensor 37 is coupled to the first plate 31 and/or the second plate 33 and configured to sense the positions of the plates 31 and 33 with respect to each other in order to determine the size of the cross-sectional area 35. It can be appreciated that the variable cross-sectional flow area 35 increases the range for flow and viscosity combinations that can be accurately measured with one specific differential pressure sensor 23 or with one combination of specific sensors 24 and 25. In general, some pressure or differential pressure sensors are more accurate at the upper end of their range. For example, in low mobility clean-up sequences, the cross-sectional flow area 35 is decreased in order to increase the pressure drop across the flow restriction element 30 to improve the accuracy of the pressure(s) being measured. Another advantage of the variable cross-sectional area 35 is related to cleaning the flow restriction element 20 if it becomes plugged by particles from mud.

Yet, another application of the variable cross-sectional area of the flow restriction element is the measurement of viscosity and density by taking the cross-sectional area as the value indicative of the fluid density and viscosity. In this application, the size of the cross-sectional area of the flow restriction element is controlled by a stepper motor with high accuracy. The differential pressure switch 26 gives a signal as soon as a certain pressure is reached. By closing the orifice or cross-sectional area until the differential pressure switch 26 gives the signal, the specific cross-sectional area for that certain pressure can be determined. With the help of a look-up table, a mathematical model, or previous testing of expected downhole fluids, the specific cross-sectional area can be converted into a value for fluid density and viscosity. The advantage of this application is that the mechanical movement of a moving part in the flow restriction element and thus the size of the cross-sectional flow area can be measured with high accuracy. Similarly, the differential pressure switch 26 can be selected to provide high accuracy at a specific differential pressure of interest.

Figure 4:
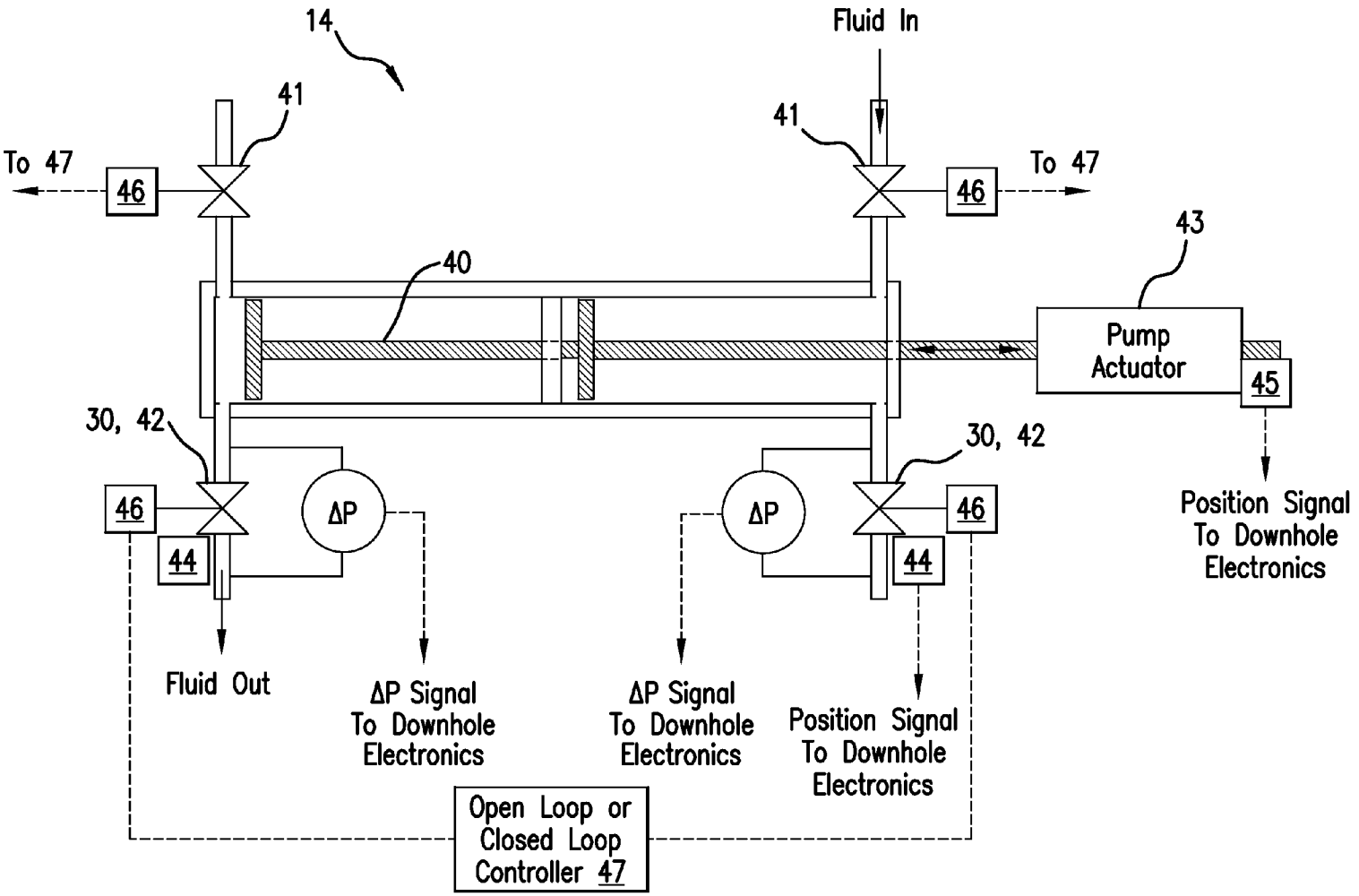
FIG. 4 depicts aspects of a viscosimeter incorporated into a formation fluid extraction pump.

Reference may now be had to FIG. 4, which depicts aspects of the viscosimeter 9 being integrated into the pump 14. In the embodiment of FIG. 4, the pump 14 is a dual-action positive displacement pump having a pumping piston 40 shown at the end of a pumping cycle in the left pumping chamber (the right chamber is shown at the end of a filling cycle). The dual-action positive displacement pump pumps on movement of the piston 40 in both directions. The pump 14 has two inlet disc valves 41 and two outlet disc valves 42, which act to keep the pumped fluid moving in one direction from inlet to outlet. In one or more embodiments, one or both of the outlet disc valves 42 is used as the flow restriction element 30. Because the outlet disc valves 42 open and close during each pump cycle, the cross-sectional flow area of these valves is variable (i.e., from closed to full open). If the opening and closing of the output disc valves 42 is carried out slow enough, then the pressure drop across each outlet valve 42 can be measured when each of those valves is full open. Hence, by measuring the pressure drop (i.e., differential pressure), knowing the cross-sectional flow area of the outlet disc valves 42, and knowing or measuring the volumetric flow rate of the pump 14, the viscosity of the pumped fluid can be determined by correlating this data to the reference data or reference curves as discussed above.

Still referring to FIG. 4, the pump 14 is open loop or closed loop controlled by a pump actuator 43. A position sensor 45 coupled to the pump 14 or the pump actuator 43 determines the position of the pump piston 40. The pump piston position is provided to the downhole electronics 7 so that it can be correlated to a phase of the pump cycle to provide indication as to when the outlet disc valves 42 are full open in order to make a differential pressure measurement. Alternatively or in addition to the position sensor 45, valve position sensors 44 coupled to the outlet disc valves 42 can be used to measure the cross-sectional flow area of the valves 42 when the differential pressure measurement is performed. The differential pressure measurement can be performed one or more times in each pump cycle. In one or more embodiments, the downhole electronics 7 can determine the volumetric flow rate of the pump 14 by calculating the velocity of the piston 40 using input from the position sensor 45. It can be appreciated that as the outlet disc valves are opened and closed the likelihood of plugging of these valves is reduced. It can be appreciated that using both outlet disc valves 42 as flow restriction elements 30 can provide for redundant measurements if one of the differential pressure sensors 5 fails. In addition, it can be appreciated that two viscosity measurements using two outlet disc valves 42 can be combined to provide one measurement of viscosity that is less susceptible to noise (i.e., having a higher signal to noise ratio) than a single viscosity measurement. It can be appreciated that one or more advantages derived from using one or more of the outlet disc valves 42 as the flow restriction element 30 includes simpler design of the tool 10 having fewer parts and a more compact design of the components in the tool 10 for conveyance in the borehole 2.

It can be appreciated that the viscosimeter 9 can be constructed with solid-state components. These components are configured to operationally withstand the high temperatures and pressures encountered in the downhole environment.

It can be appreciated that density can be related to viscosity. Hence, output of the viscosimeter 9 can also be used to estimate the density of the fluid of interest.

Figure 5:
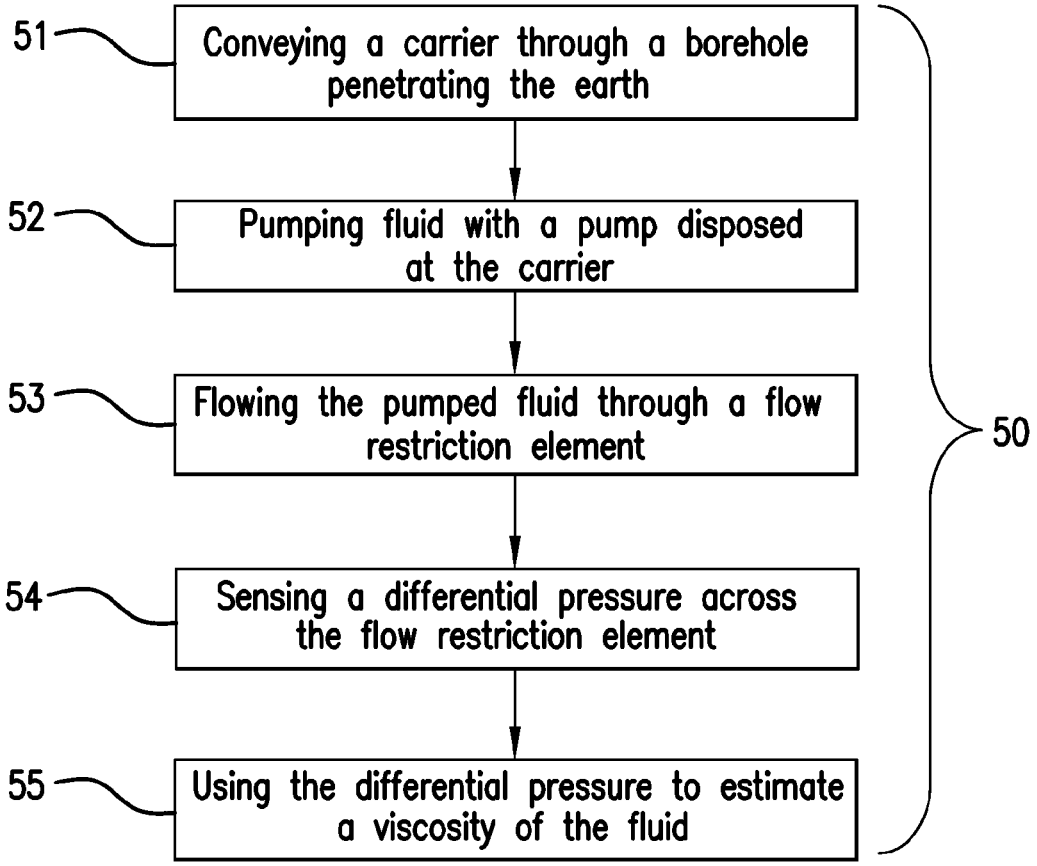
FIG. 5 presents one example of a method for estimating a viscosity or density of a fluid downhole.

FIG. 5 presents one example of a method (method 50) for estimating a viscosity or density of a fluid downhole. The method 50 calls for (step 51) conveying a carrier through a borehole penetrating the earth. Further, the method 50 calls for (step 52) pumping the fluid with a pump disposed at the carrier. Further the method 50 calls for (step 53) flowing the pumped fluid through a flow restriction element. The flow restriction element can be disposed in a fluid conduit or it can be a valve that is part of a pump or another component in a downhole tool. Further, the method 50 calls for (step 54) sensing a differential pressure across the flow restriction element. Further the method 50 calls for (step 55) using the differential pressure to estimate the viscosity. The method 50 can also include determining a volumetric flow rate through the flow restriction element. In addition, the method 50 can include determining a cross-sectional flow area of a variable flow restriction element.

Figure 6:
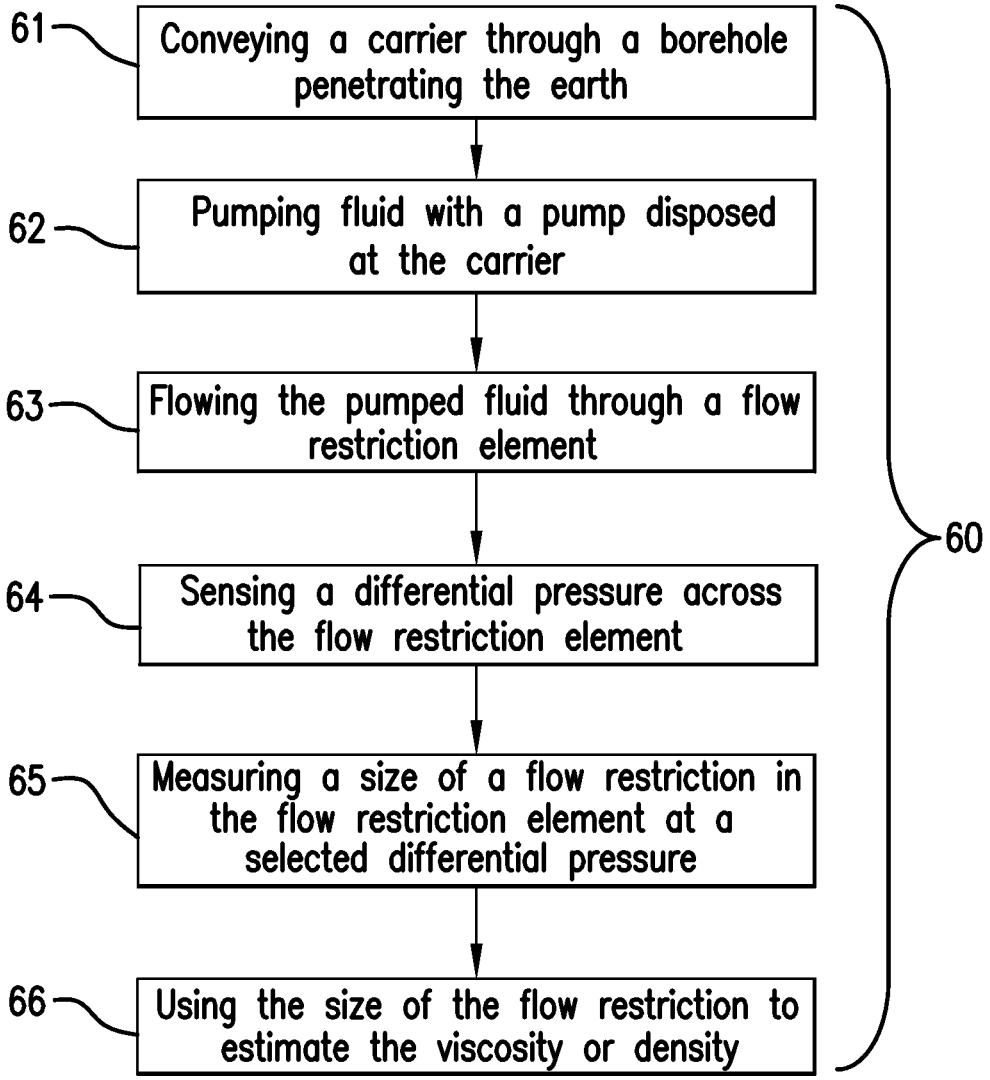
FIG. 6 presents another example of a method for estimating a viscosity or density of a fluid downhole

FIG. 6 presents another example of a method (method 60) for estimating a viscosity or density of a fluid downhole. The method 60 calls for (step 61) conveying a carrier through a borehole penetrating the earth. Further, the method 60 calls for (step 62) pumping the fluid with a pump disposed at the carrier. Further the method 60 calls for (step 63) flowing the pumped fluid through a flow restriction element. Further, the method 60 calls for (step 64) sensing a differential pressure across the flow restriction element. Further, the method 60 calls for (step 65) measuring a size of a flow restriction in the flow restriction element at a selected differential pressure. The size can be directly measured using a sensor or indirectly measured by measuring a position of an actuator that controls the size of the flow restriction. Further, the method 60 calls for (step 66) using the size of the flow restriction to estimate the viscosity or density.

In support of the teachings herein, various analysis components may be used, including a digital and/or an analog system. For example, the downhole electronics 7 or the surface computer processing 8 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order. The term "couple" relates to a first device being coupled to a second device either directly or indirectly through an intermediate device.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for estimating a viscosity or density of a fluid downhole, the apparatus comprising:

a carrier configured to be conveyed through a borehole penetrating the earth;

a pump disposed at the carrier and configured to pump the fluid;

a flow restriction element having a variable cross-sectional flow area and configured to receive a flow of the fluid pumped by the pump and to reduce pressure of the fluid flowing through the flow restriction element, the flow restriction element comprising a moveable element configured to move in order to vary the cross-sectional flow area;

a sensor configured to measure a differential pressure across the flow restriction element; and a sensor configured to sense a size of the cross-sectional flow area of the flow restriction element;

wherein an output of the sensor configured to sense differential pressure and an output of the sensor configured to sense a cross-sectional area provide input to estimating the viscosity or density.

2. The apparatus according to claim 1, wherein the flow restriction element is an orifice.

3. The apparatus according to claim 1, wherein the flow restriction element comprises two overlapping plates, each plate defining an opening, the two plates being configured to move in relation to each other to provide the variable cross-sectional area.

4. The apparatus according to claim 3, wherein the two plates are flat and at least one of the two plates is configured to move linearly.

5. The apparatus according to claim 3, further comprising an actuator coupled to at least one of the two plates and configured to move at least one of the two plates in relation to each other.

6. The apparatus according to claim 1, wherein the sensor comprises a differential pressure sensor configured to measure a difference in pressure between an upstream side and a downstream side of the flow restriction element.

7. The apparatus according to claim 1, wherein the sensor comprises a first pressure sensor coupled to an upstream side of the flow restriction element and a second pressure sensor coupled to a downstream side of the flow restriction element.

8. An apparatus for estimating a viscosity or density of a fluid downhole, the apparatus comprising:

a carrier configured to be conveyed through a borehole penetrating the earth;

a displacement pump disposed at the carrier and configured to pump the fluid;

a flow restriction element comprising an outlet valve of the displacement pump and configured to receive a flow of the fluid pumped by the pump and to reduce pressure of the fluid flowing through the flow restriction element, the flow restriction element comprising a moveable part configured to move in order to vary a cross-sectional flow area;

a sensor configured to measure a differential pressure across the flow restriction element; and a position sensor configured to sense a position of the moving part of the outlet valve in order to determine a size of the cross-sectional flow area of the outlet valve;

wherein an output of the sensor configured to sense differential pressure and an output of the sensor configured to sense a position of the moving part provide input to estimating the viscosity or density.

9. The apparatus according to claim 8, wherein the outlet valve is disc valve.

10. An apparatus for estimating a viscosity or density of a fluid downhole, the apparatus comprising:

a carrier configured to be conveyed through a borehole penetrating the earth;

a displacement pump disposed at the carrier and configured to pump the fluid;

a flow restriction element comprising an outlet valve of the displacement pump and configured to receive a flow of the fluid pumped by the pump and to reduce pressure of the fluid flowing through the flow restriction element, the flow restriction element comprising a moveable element configured to move in order to vary a cross-sectional flow area;

a sensor configured to measure a differential pressure across the flow restriction element; and a position sensor configured to sense a position of a piston of the displacement pump in order to sense a position of the moveable element that indicates a size of the cross-sectional flow area of the outlet valve;

wherein an output of the sensor configured to sense differential pressure and an output of the sensor configured to sense a position of a piston of the displacement pump provide input to estimating the viscosity or density.

11. The apparatus according to claim 10, further comprising downhole electronics configured to measure a rate of change of the position sensor in order to determine a flow rate of the pump.

12. A method for estimating a viscosity or density of a fluid downhole, the method comprising:

conveying a carrier through a borehole penetrating the earth;

pumping the fluid with a pump disposed at the carrier;

flowing the pumped fluid through a flow restriction element having a variable cross-sectional flow area, the flow restriction element comprising a moveable element configured to move in order to vary the cross-sectional flow area;

sensing a differential pressure across the flow restriction element;

sensing a cross-sectional flow area of the flow restriction element using a sensor configured to sense a size of the cross-sectional flow area of the flow restriction element; and using the differential pressure and the sensed size of the cross-sectional flow area to estimate the viscosity or density.

13. The method according to claim 12, further comprising determining a flow rate of the fluid flowing through the flow restriction element.

* * * * *